US005683019A

United States Patent [19]

Schaber

[11] Patent Number: 5,683,019

[45] Date of Patent: Nov. 4, 1997

[54] WAISTBAND SUPPORTED CARRIER FOR TENNIS BALLS

[76] Inventor: Viola G. Schaber, 15019 - 91st Ave. No., Maple Grove, Minn. 55369

[21] Appl. No.: 607,148

[22] Filed: Feb. 26, 1996

Related U.S. Application Data

[63] Continuation of Ser. No. 349,551, Dec. 5, 1994, abandoned.

[51] Int. Cl.[6] ..... A45F 5/00

[52] U.S. Cl. ..... 224/191; 224/666; 224/677; 224/919; 224/683; 383/33

[58] Field of Search ..... 224/919, 191, 224/666, 667, 669, 677, 683; 2/247; 383/33, 907, 122

[56] References Cited

U.S. PATENT DOCUMENTS

| | | | |
|---|---|---|---|
| 367,996 | 8/1887 | Nathan | 224/226 |
| 2,558,382 | 6/1951 | Previdi . | |
| 2,825,068 | 3/1958 | Montgomery . | |
| 3,051,130 | 8/1962 | Morris | 224/42.46 R |
| 3,379,349 | 4/1968 | Hier | 224/253 |
| 3,380,635 | 4/1968 | Stone et al. | 224/197 |
| 3,624,686 | 11/1971 | Beals . | |
| 3,915,361 | 10/1975 | Perkins | 224/679 |
| 4,079,871 | 3/1978 | Sica . | |
| 4,139,914 | 2/1979 | Tarr . | |
| 4,294,386 | 10/1981 | Ingram . | |
| 4,444,342 | 4/1984 | Powell | 224/667 |
| 4,667,347 | 5/1987 | Greer | 2/247 |
| 5,186,374 | 2/1993 | Buxton . | |
| 5,234,214 | 8/1993 | Sexton et al. . | |
| 5,259,541 | 11/1993 | Reese . | |
| 5,265,781 | 11/1993 | Nichols | 224/252 |

*Primary Examiner*—Linda J. Sholl
*Attorney, Agent, or Firm*—Kinney & Lange, P.A.

[57] ABSTRACT

A carrier for tennis balls includes a pocket with an open top, a retaining tab incorporating a plastic stiffening panel, and an inextensible but pliant connecting means for joining the retaining tab to the pocket near the top opening. The pocket is formed with a substantially flat back panel and a front section that tends to protrude outwardly from the back panel giving the top opening a D-shaped top edge sized to conveniently accommodate a single tennis ball. The pocket diverges in the direction away from the top opening, so that along its bottom the pocket can accommodate two tennis balls side by side. The pocket, connecting region and two cover layers of the retaining tab preferably are formed from a single piece of woven fabric. The material nap, and the plastic panel stiffness, cooperate to enhance frictional retention of the tab when the tab is inserted inside a garment, between the garment waistband and the body. When so inserted, the tab supports the pocket and its contents by suspension through the connecting region.

10 Claims, 4 Drawing Sheets

54

70
56
58
62
60
61
64
68
72
66

WAISTBAND SUPPORTED CARRIER FOR TENNIS BALLS

This is a continuation of application Ser. No. 08/349,551, filed Dec. 5, 1994.

BACKGROUND OF THE INVENTION

The present invention relates to pockets, pouches and other carrying devices adapted for removable attachment to clothing, and more particularly to carrying devices suited for mounting along the waistlines of skirts, pants and other garments.

The rules of tennis allow a second service to a player who faults on the first serve. Accordingly, the serving player should have at least two tennis balls to avoid the need to immediately retrieve a fault and delay the game. Many players are unable to conveniently hold two tennis balls in one hand. Even among those who can, there is an increasing preference to avoid holding tennis balls, given the increasing popularity of the two-handed backhand stroke. Consequently, many players tend to store one or more tennis balls in any pockets provided in their clothing. However, much of today's activewear, whether or not it is designed for tennis, either has no pockets or lacks pockets large enough to carry tennis balls. This encourages some players to place extra balls on the playing surface, a practice that is inconvenient and potentially hazardous if balls are placed near the playing area.

Recognition of this problem has led to several tennis ball carrier designs for example, U.S. Pat. No. 4,294,386 (Ingram) discloses a tennis ball holder with three flexible tabs that form a cage for the tennis ball. A fourth tab is secured behind a belt, or inside a back pocket. U.S. Pat. No. 5,259,541 (Reese) shows a one-piece bag for carrying tennis balls, and a belt for supporting the bag. Similarly, U.S. Pat. No. 4,079,871 (Sica) shows a belt-type carrier for several tennis balls.

Several other carriers, whether or not directed specifically to tennis balls, show fastening means other than belts. U.S. Pat. No. 5,234,214 (Sexton) shows a hook and loop or "Velcro" fastening arrangements to hold a tennis ball or a tennis ball carrying pocket. U.S. Pat. No. 4,139,914 (Tarr) discloses a security pocket carried inside the garment. One version is belt-supported, with further arrangements involving snaps, buttons and a zipper. The aforementioned Ingram patent discloses alternatives such as buttons, hook and loop closure, a clip, and a tab insertable into loops sewn into the garment.

For user convenience, much of today's activewear including tennis clothing is provided with elastic waistbands, internal drawstrings that are tightened about the waist, or a combination of these features. Carriers with loops designed to accept belts cannot be used with these garments. Carriers that incorporate their own belts are inconvenient and are a source of discomfort and distraction during play. Pouches that employ buttons, snaps and hook and loop closure require a special or "retrofitted" garment with a complementary buttonhole, snap, etc.

Therefore, it is an object of the present invention to provide a carrier that can be supported simply by insertion of a portion of the carrier inside of a garment waistband for frictional retention by the waistband alone.

Another object is to provide a retaining tab that can be tucked into a garment between the garment's waistband and the individual wearing the garment, which tab tends to conform circumferentially to the waistband yet retains sufficient stiffness to resist its removal other than by vertical pulling.

A further object is to provide a combination carrier and carrier retaining tab adapted for simple, low cost construction from a single piece of woven fabric.

Yet another object is to provide a waistband supported carrier particularly well suited for combining the holding of two or more tennis balls with individual tennis ball (only) insertion or removal.

SUMMARY OF THE INVENTION

To achieve these and other objects, there is provided a waistband supported carrying device. The device includes a tab means positionable between an elastic waistband of a garment and an individual wearing the garment. The tab means comprises a flat and flexible retaining member adapted to extend circumferentially along a narrow space between the waistband and the individual and to yield elastically thereby tending to conform circumferentially to the space. Means are provided on opposite sides of the retaining member for enhancing a frictional retention of the tab means between the waistband and the individual. The device further includes a pocket having a top opening and a inextensible and compliant connecting means for joining the tab means to the pocket near the top opening. The connecting means is adapted to overly a top edge of the waistband and support the pocket by suspension outside of the garment during its frictional retention.

Preferably, the means for enhancing frictional retention comprise first and second pliable fabric layers on opposite sides of the retaining member. The nap of the fabric layers enhances frictional engagement with the waistband material on one side, and with the individual (or other material, e.g. a tucked in shirt) on the other. The retaining member can be a sheet of flexible plastic, having its length dimension running in the direction of the waistband. Consequently, the plastic sheet tends to conform by curving circumferentially about the waist of the individual, i.e. about a generally vertical axis. This curvature, however slight, lends stiffness to the sheet so that the sheet resists bending about an axis parallel to the waistband, i.e. generally horizontal. Accordingly, the plastic sheet tends to pivot, rather than slip out of its position inside the waistband, in response to the downward force of the pocket and any objects in the pocket.

By contrast, the connecting means is formed of a woven fabric and conforms to the waistband, assuming an inverted U-shape as it overlies the upper edge of the waistband.

The pocket can include a backing, and a front section peripherally attached to the backing, e.g. by stitching. The backing, front section, fabric layers covering the plastic sheet and the connecting means, all can be formed from a single piece of woven fabric for a simple and low cost construction. In a version of the carrier particularly well suited for tennis balls, the front section protrudes from the pocket to define a substantially D-shaped top opening, sized to allow insertion or removal of one, but only one, tennis ball. The front section and backing both diverge in the downward direction away from the opening, such that a length of the pocket near its bottom is sufficient to accommodate two tennis balls side-by-side. This arrangement affords convenient insertion and removal of tennis balls, yet also minimizes unintended escape of one or more tennis balls during play. The pocket height preferably is sufficient for storing an additional tennis ball above the side-by-side pair.

The carrier is secured, simply by tucking the tab portion downwardly to a position between the garment waistband and the body. There is no need to thread loops through a belt or to fasten a belt, snaps, buttons or other fasteners. After use, the carrier is conveniently removed, by gripping the pocket and pulling it upward to lift the tab upwardly away from the waistband.

The light weight of the carrier and any tennis balls contained in the pocket, the circumferential conformance of the plastic sheet, and the fabric overlying the plastic sheet on both sides, provide considerably more comfort as compared to prior carrier designs, to the point where the carrier is hardly noticed during play. When not in use, the carrier compliantly assumes a flat configuration or any other desired shape. The flat configuration is particularly suitable for bulk storage and shipping.

If desired, an auxiliary pocket can be incorporated into the backing with a zipper, Velcro or other closure for securing smaller objects such as coins or keys. The front section of the pocket provides a convenient and conspicuous location for applying a logo, advertising or other message.

IN THE DRAWINGS

For a further understanding of the above and other features and advantages, reference is made to the following detailed description and to the drawings, in which.

DETAILED DESCRIPTION OF THE PREFERRED EMBODIMENTS

Figure 1:
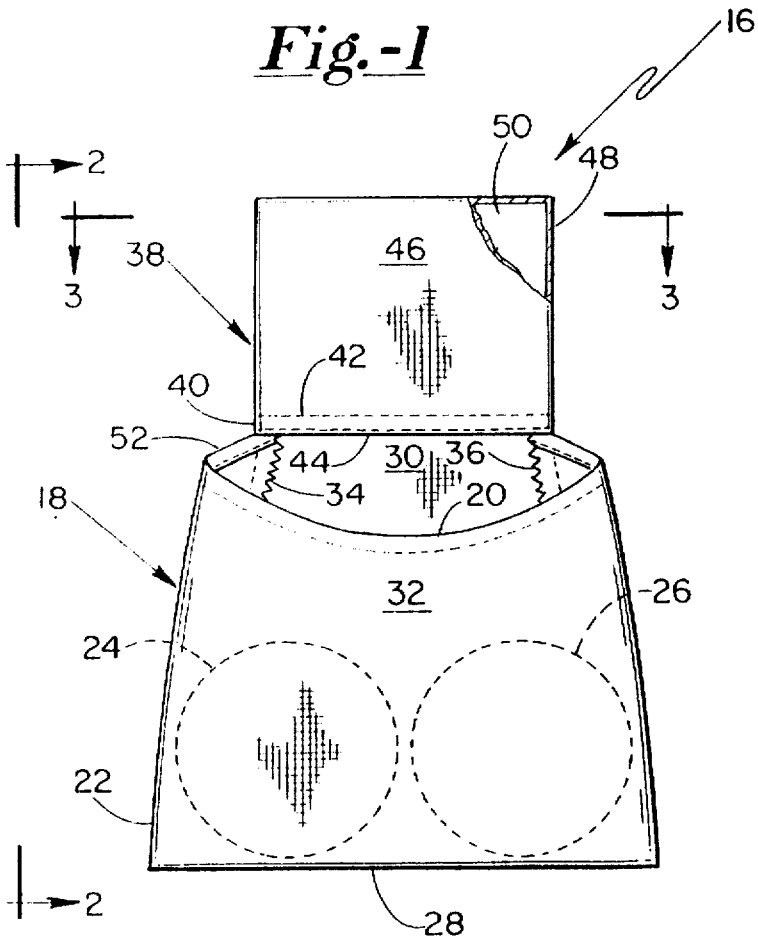
FIG. 1 is a front elevation of a carrier for tennis balls constructed according to the present invention.
Figure 2:
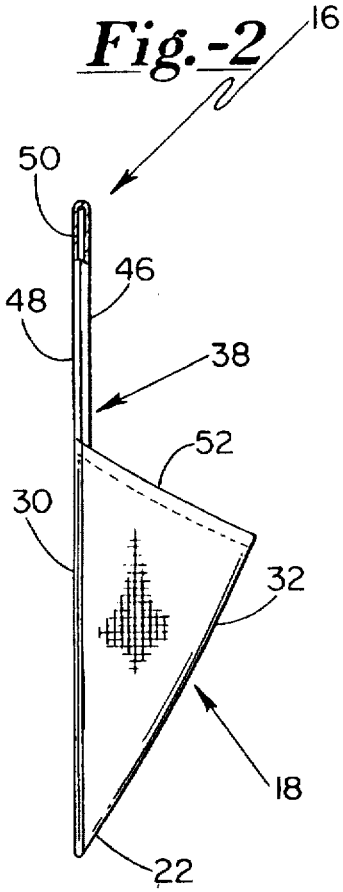
FIG. 2 is a side elevation of a carrier.
Figure 3:
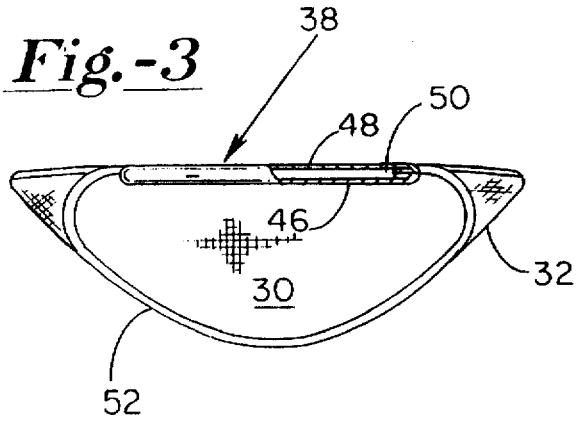
FIG. 3 is a top view of the carrier.

Turning now to the drawings, there is shown in FIGS. 1–3 a waistband supported carrier 16 for carrying up to three tennis balls. With particular reference to FIG. 1, the carrier includes a pocket 18 with a top opening 20 large enough to admit a single tennis ball into the pocket, but also sufficiently small to prevent simultaneous passage of two tennis balls through the opening. The pocket is tapered, i.e. diverging in the direction downwardly away from opening 20. Thus, along a bottom region 22 of the pocket, two tennis balls can be supported side-by-side as indicated by broken lines at 24 and 26. Pocket 18 is formed by folding along a bottom edge 28 to define a back panel or back section 30 and a front section 32, with side seams 34 and 36 along the back panel and front section to join them.

Back panel material extends upwardly of opening 20, to provide a planar and rectangular retaining tab 38. Back panel material between tab 38 and pocket 18, indicated at 40 between the pair of horizontal broken lines, provides a pliable, inextensible connecting region between the retaining tab and the pocket. The broken lines, designated 42 and 44, represent stitching of the back panel material. The material is folded over upon itself to form a front cover layer 46 and a back cover layer 48, with flat and flexible retaining panel 50 between the cover layers. In FIGS. 1–3, portions of the cover layers are removed, to reveal the retaining panel.

The carrier, with the exception of retaining panel 50 and stitching, is constructed entirely of a pliable and inextensive material, e.g. a firm woven fabric such as cotton, nylon, canvas, duck cloth, linen, silk, rayon or polyester. Because the carrier is compliant, it tends to assume a flat configuration when placed on a table or other horizontal surface. This configuration is shown in FIG. 1. However, when held vertically by retaining tab 38, the carrier tends to assume the configuration in FIGS. 2 and 3, with front section 32 protruding away from the back panel, particularly in the region of opening 20. The result, as best seen in FIG. 3, is that an upper edge 52 of the pocket assumes a shape similar to the letter "D", thus to define the opening. The linear portion of the opening runs along and just below retaining tab 38, and has a length of about 4 inches. The corresponding length of bottom edge 28 is about 7½ inches.

While the retaining tab is preferably about 4 inches long, a length of at least 3 inches is satisfactory. The length can be up to about 5 inches. More generally, the retaining tab should be sufficiently long, in the direction that a garment waistband extends, to provide the necessary support for the pocket, yet not so long as to be a source of discomfort. Similarly, the preferred width of the retaining tab, vertically as viewed in FIGS. 1 and 2, is at least 1.5 inches, and more preferably about 3 inches.

Figure 4:
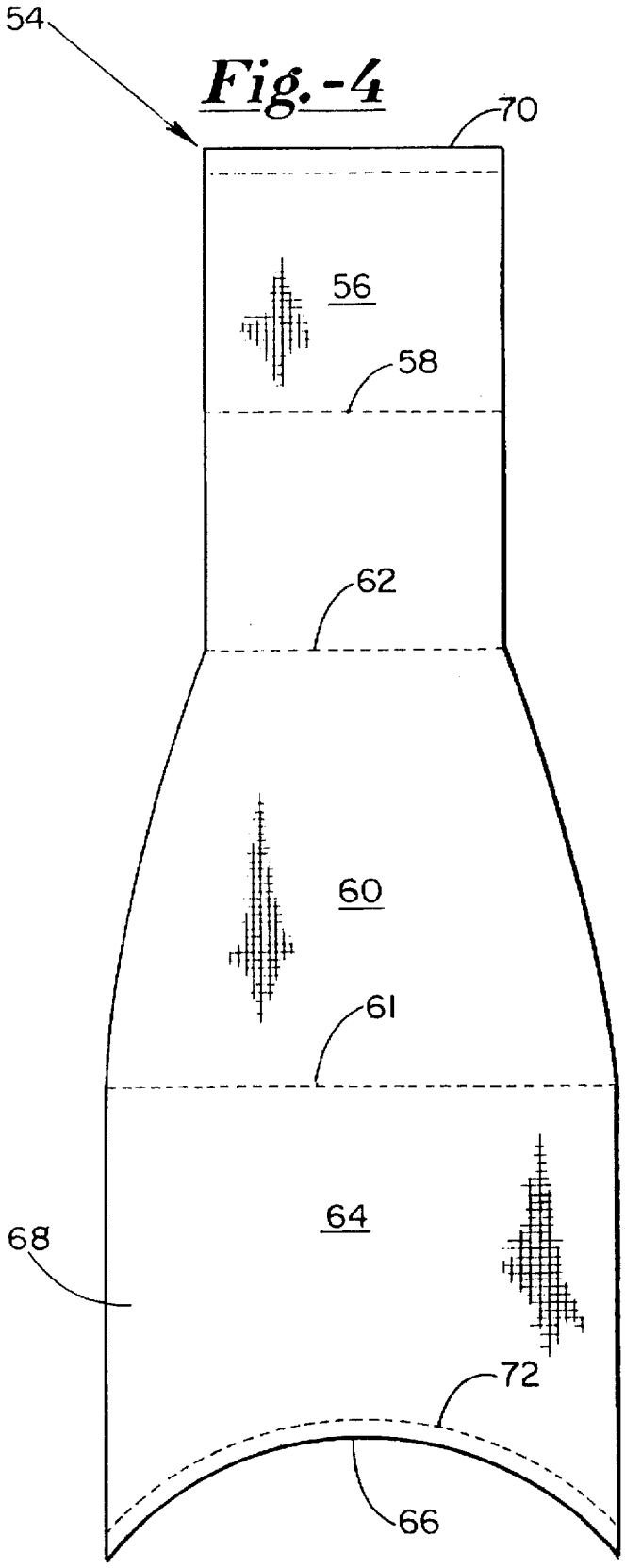
FIGS. 4–6 illustrate stages in the fabrication of the carrier.

Carrier 16 preferably is formed from a single sheet of the woven fabric. As seen in FIG. 4, the fabric piece designated 54 includes three regions: a tab region 56 corresponding to the retaining tab and having a substantially centered fold line 58; a medial region 60 between a fold line 61 and a center line 62 corresponding to the back panel; and an end region 64 with a concave edge 66, corresponding to the front section of the pocket. The fold lines and center lines can be marked with chalk. The lines are marked on an inside surface 68 of fabric piece 54, i.e. the surface that eventually will form the inside of the pocket and retaining tab.

First, a ¼ fold is formed at the edge of tab region 56. At the opposite end of the fabric piece, concave edge 66 is turned under and stitched. These steps are indicated at 70 and 72 in FIG. 4.

Figure 5:
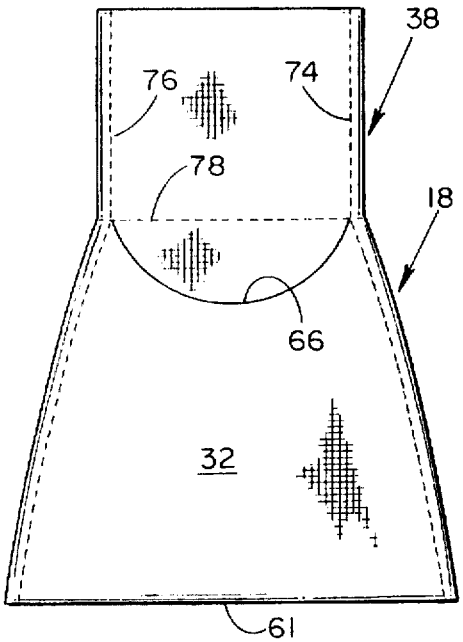

Next, tab region 56 is folded along fold line 58 and the material also is folded along fold line 61. These folds are made to form an "inside out" configuration, i.e. with surfaces confronting one another that eventually will be on the outside of the retaining tab and pocket, respectively. With the end of tab region 56 and concave edge 66 (particularly its pointed ends) held together at center line 62, side seams 34 and 36 are stitched, with a ¼ inch seam allowance. This stitching forms the pocket and the adjacent cover layers of the retaining tab, while leaving the bottom of the tab open for insertion of the plastic reinforcing panel. The result is seen in FIG. 5.

Figure 6:
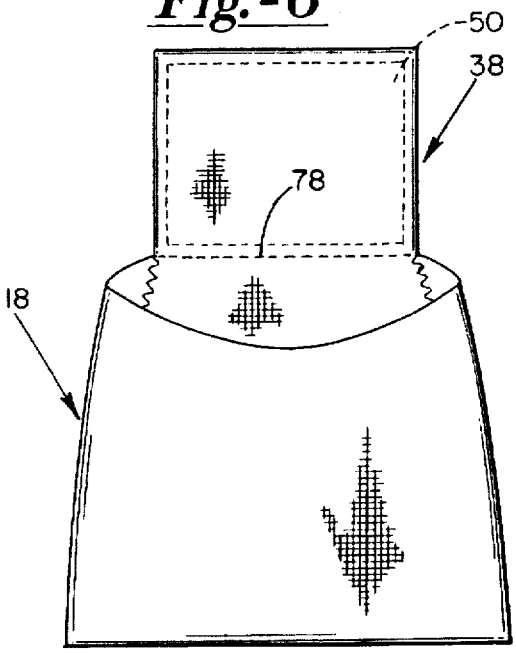

At this stage, the carrier is turned "inside out", which of course positions the intended exterior surfaces on the outside, while concealing the excess material beyond the side seams. Plastic panel 50 is inserted into the space between cover layers 46 and 48, and between tab seams 74 and 76. Following insertion, a straight seam 78 joins the cover layers together just below the plastic panel. Side seams 34 and 36, at least near top opening 20, are reinforced with zig-zag stitching. The result is shown in FIG. 6.

Figure 7:
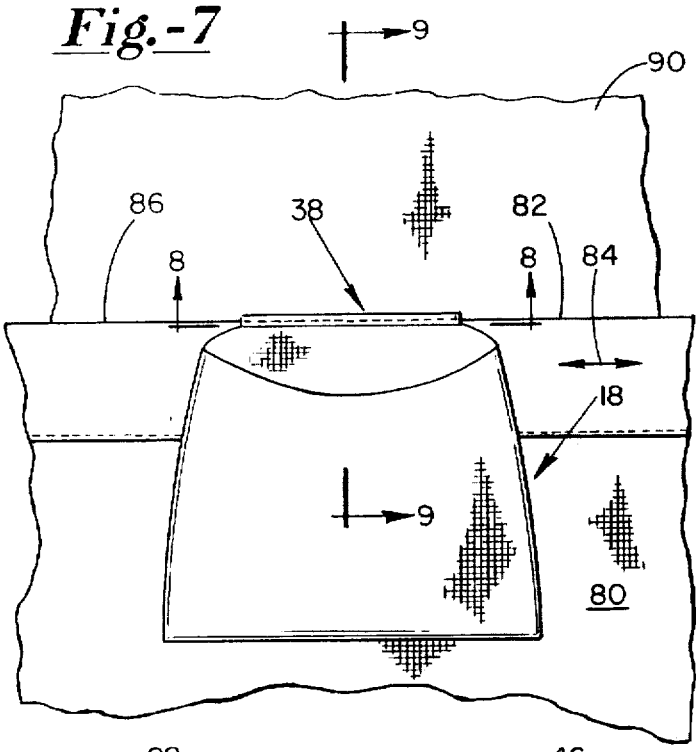
FIG. 7 is a forward elevation illustrating the carrier in use.
Figure 9:
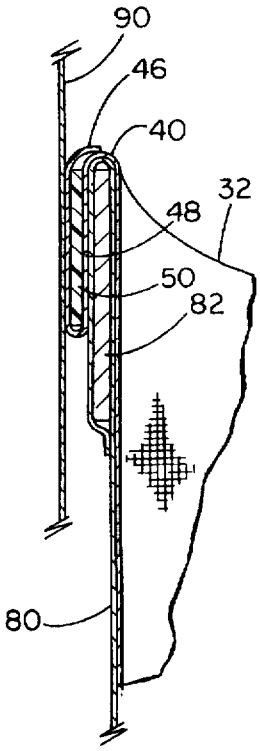
FIG. 9 is a sectional view taken along the line 9—9 in FIG. 7.
Figure 8:
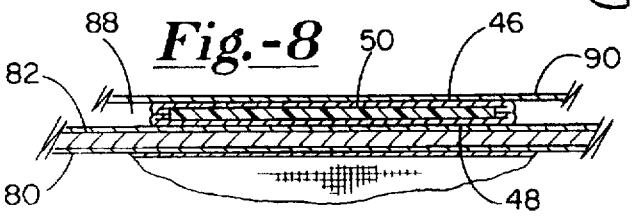
FIG. 8 is a sectional view taken along the line 8—8 in FIG. 7.

FIGS. 7–9 illustrate how carrier 16 is held by a garment with an elastic waistband. FIG. 7 shows part of a garment, e.g. a tennis skirt 80 having an elastic waistband 82. When the garment is worn, the waistband is stretched and thus is under a tensile force in the circumferential direction as indicated by arrows at 84. Pocket 18 is supported by suspension from a top edge 86 of waistband 82.

As seen in FIG. 8, retaining tab 38 occupies a narrow space 88 between waistband 82 and the individual wearing the tennis skirt. More particularly, back cover layer 48 of the tab is contiguous with the waistband, while front cover layer 46 is contiguous with (for example) a tennis shirt 90 tucked into the skirt. Retaining tab 38 is slightly curved, as it tends to conform to the contour of the waistband in the circumferential direction.

With reference to FIG. 9, it is seen that when inserted between skirt waistband 82 and shirt 90, retaining tab 38 is generally vertical, although more particularly conforming to the space between the waistband and shirt. Connecting region 40, being formed of the woven fabric, is compliant and overlies top edge 86, conforming to the waistband to assume an inverted U configuration. Pocket 18 is supported from connecting region 40, and thus exerts a vertically downward force on the connecting region.

The size and shape of retaining tab 38, and the materials in its construction, provide for ease in the tab's insertion and removal, yet lend effective support in retaining the pocket and up to three tennis balls contained in the pocket.

The retaining tab dimensions have been discussed above. A salient feature is that the retaining length (circumferential, FIG. 8) exceeds its width (vertical, FIG. 9). As a result, the resilient bending of retaining panel 50 tends to be about a vertical axis. This bending, while slight as seen in FIG. 8, stiffens panel 50 against any bending about a horizontal axis, i.e. bending that would cause curvature in the view of FIG. 9. Accordingly there is no tendency in the retaining tab to curl about or otherwise conform to waistband 82, as is the case with connecting region 40.

Rather, the force of the suspended pocket, acting through the connecting region, attempts to pivot the retaining tab clockwise as viewed in FIG. 9. The tendency to pivot, however, is readily overcome by the radially inward holding force of the waistband.

Moreover, the nap of the fabric along contiguous surfaces, i.e. waistband 82/cover layer 48 and shirt 90/cover layer 46, insures a positive frictional engagement to secure the retaining tab against any vertical force applied through the connecting region. Thus, the force of elastic waistband 82 is all that is necessary to support pocket 18. There is no need for a belt, buttons, hook and loop fasteners or other auxiliary means.

At the same time, carrier 16 is easy to use. The retaining tab is inserted simply by pushing it downward between the waistband and shirt. Removal of the retaining tab is accomplished by gripping the pocket or connection region by hand and pulling upward with a force sufficient to overcome the friction between the retaining tab and the adjacent materials.

Due to the fabric construction, pocket 18 is extremely lightweight. The combined weight of the pocket and up to three tennis balls is similarly slight. This affords several advantages, one being that a player using carrier 16 during active play is unlikely to be aware of the carrier, much less experience distraction or discomfort. A second result is that relatively slight force (due to friction and waistband tension) is sufficient to support the carrier, meaning that the retaining tab is easily inserted and removed.

Figure 10:
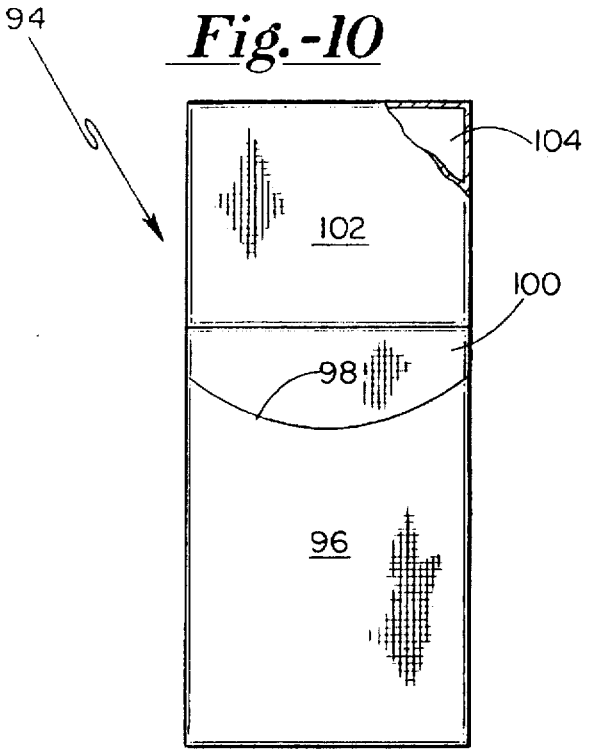
FIG. 10 is a forward elevation of an alternative embodiment carrier.

FIG. 10 shows an alternative embodiment carrier 94 for objects of smaller size, e.g. coins or keys. Carrier 94 includes a pocket 96 that diverges downwardly in the direction from an open top 98. Alternatively, a top opening could be provided with a hook and loop, zipper or other closure. A pliant and inextensible material serves as a connecting region 100, for joining the pocket and a retaining tab 102. Tab 102 is formed by sewing or otherwise attaching a rectangular portion of the material to a similarly shaped leather strip 104. Preferably the material is contiguous with the smoother side of leather strip 104, leaving the rougher surface exposed to improve frictional retention. If desired, hook and loop closure material (not shown) can be sewn on the back of pocket 96 and on the garment, to hold the pocket against the garment. This embodiment is particularly well suited for running or jogging, where the user is wearing a pair of sweat pants with an elastic or drawstring waistband.

Figure 11:
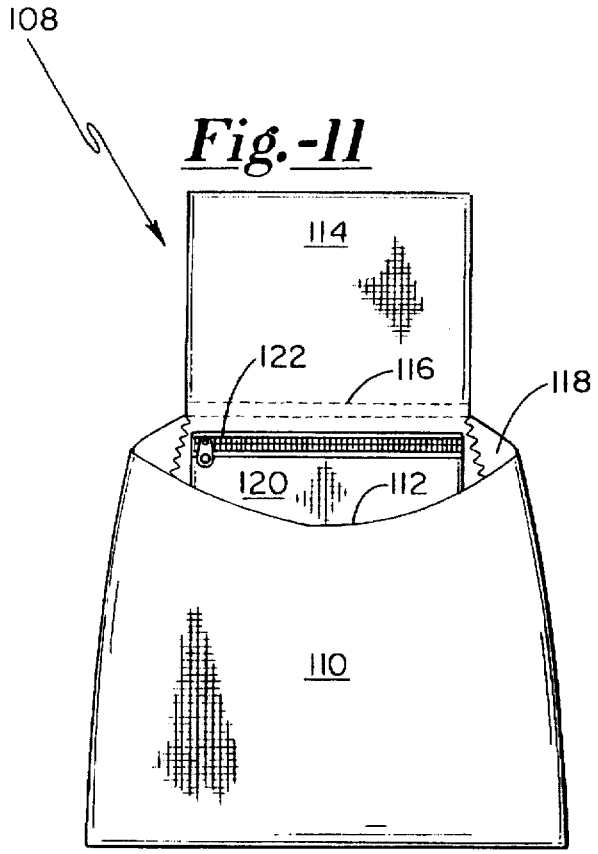
FIG. 11 is a forward elevation of a further alternative embodiment carrier.

FIG. 11 shows a further embodiment carrier 108 including a downwardly diverging pocket 110 with a top opening 112, a retaining tab 114 and a pliable and inextensible connecting region 116 between the pocket and the tab. Further, additional material is sewn to a back panel 118 of the pocket, to form an auxiliary pocket 120 for carrying keys or coins. The auxiliary pocket is closed with a zipper 122. However, alternative closures can be substituted.

Thus in accordance with the present invention, a pocket for carrying tennis balls and other objects is supported entirely by friction in combination with the tensile force of a garment waistband. The retaining tab is easily tucked into position between the body and the waistband. An applied vertical force readily removes the tab after use of the carrier. The stiffness of the retaining tabs prevents it from being pulled away due to the weight of the pocket and its contents. When the front section is configured to protrude from the back panel, a top opening is maintained that is convenient for individual insertion and removal of tennis balls. The opening does not accommodate more than one ball. However, due to a downward divergence of the pocket, the pocket accommodates two balls side by side along its bottom edge and can contain up to three tennis balls. The container can be matched to the garment as a fashion accessory and provides a conspicuous location for presenting a logo or advertisement.

What is claimed is:

1. A tennis ball carrier comprising:

a cloth pouch having a generally rectangular front panel section and a generally trapezoidal back panel section secured to one another to form a collapsible pocket sized to hold tennis balls and having closed sides, a top opening, and a closed bottom; wherein the front panel section has an upper edge which is generally concave and is longer than an upper edge of the back panel section, and wherein the back panel section is substantially flat, and the front panel section is secured along side and bottom edges to the back panel section and protrudes away from the back section to define the closed sides and a front of the cloth pouch, with the upper edges of the front panel section and the back panel section defining a D-shaped profile for the top opening when a tennis ball is in the cloth pouch; and a retaining tab for insertion between a waistband of a garment and an individual wearing the garment to hold the cloth pouch in position outside the garment, the retaining tab being flexibly connected to the upper edge of the back panel section of the cloth pouch and including a cloth front layer, a cloth back layer, and a flexible stiffener sheet enclosed between the cloth front layer and the cloth back layer, the flexible stiffener having length and width dimensions which are approximately similar to length and width dimensions of the cloth front and back layers.

2. The tennis ball carrier of claim 1 wherein the flexible stiffener sheet is a flexible plastic sheet.

3. The tennis ball carrier of claim 1 wherein the pocket diverges downwardly away from the top opening.

4. The tennis ball carrier of claim 1 wherein the front panel section, back panel section, cloth front layer and cloth back layer are formed from a single piece of cloth fabric.

5. The tennis ball carrier of claim 1 wherein the retaining tab is rectangular, having a length in the range of about 3–5 inches and a width of at least about 1.5 inches, with the length taken in a horizontal direction.

6. The tennis ball carrier of claim 1, further including:

an auxiliary pocket formed adjacent the back panel section.

7. A tennis ball carrier comprising:

a cloth pouch having a generally rectangular cloth front panel section and a generally trapezoidal cloth back panel section secured to one another to form a collapsible pocket sized to hold tennis balls and having closed sides, a top opening, and a closed bottom; wherein the cloth pocket diverges downwardly away from the top opening and wherein the back panel section is substantially flat, and the front panel section is secured to the back panel section along respective bottom and side edges to protrude away from the back section to define a front and the closed sides of the cloth pouch, the front panel section having an upper edge which is generally concave and is longer than an upper edge of the back panel section so that the top opening has a D-shaped profile when a tennis ball is in the cloth pouch; and a retaining tab for insertion between a waistband of a garment and an individual wearing the garment to hold the cloth pouch in position outside the garment, the retaining tab being flexibly connected to the upper edge of the back panel section of the cloth pouch and including a cloth front layer, a cloth back layer, and a flexible plastic stiffener sheet enclosed between the cloth front layer and the cloth back layer, the flexible plastic stiffener sheet having length and width dimensions which are approximately similar to length and width dimensions of the cloth front and back layers, and wherein the retaining tab is rectangular, with a length in the range of about 3–5 inches and a width of at least about 1.5 inches, with the length taken in a horizontal direction.

wherein the cloth front layer and cloth back layer are formed from a single piece of cloth fabric.

8. A tennis ball carrier comprising:

a cloth pouch having a generally rectangular front panel section and a back panel section secured to one another to form a collapsible pocket sized to hold a plurality of tennis balls and having a front, a back, closed sides, a top opening, and a closed bottom;

wherein the front panel section has a bottom edge, a concave top edge, and a pair of side edges;

wherein the back panel section has a bottom edge attached to and equal in length to the bottom edge of the front panel section, a top edge which is shorter than the top edge of the front panel section and a pair of side edges attached to the side edges of the front panel section so that the front panel section forms the front and the closed sides of the cloth pouch; and a retaining tab for insertion between a waistband of a garment and an individual wearing the garment to hold the cloth pouch in position outside the garment, the retaining tab being flexibly connected to the upper edge of the back panel section of the cloth pouch and including a cloth front layer, a cloth back layer, and a flexible stiffener sheet enclosed between the cloth front layer and the cloth back layer, the flexible stiffener having length and width dimensions which are approximately similar to length and width dimensions of the cloth front and back layers.

9. The tennis ball carrier of claim 8 wherein the back section is substantially flat, and the front panel section protrudes away from the back panel section so that the upper edges of the front panel section and the back panel section define a D-shaped profile for the top opening when a tennis ball is in the cloth pouch.

10. The tennis ball carrier of claim 8 wherein the front panel section, back panel section, cloth front layer and cloth back layer are formed from a single piece of cloth fabric.

* * * * *